US011491636B2

(12) United States Patent
Maturo et al.

(10) Patent No.: US 11,491,636 B2
(45) Date of Patent: Nov. 8, 2022

(54) SMALL-SIZE, MOVABLE WORKSTATION

(71) Applicant: UNIFOR S.P.A., Turate (IT)

(72) Inventors: Marco Maturo, Turate (IT); Alessio Roscini, Turate (IT)

(73) Assignee: UNIFOR S.P.A., Turate (IT)

( * ) Notice: Subject to any disclaimer, the term of this patent is extended or adjusted under 35 U.S.C. 154(b) by 192 days.

(21) Appl. No.: 16/840,503

(22) Filed: Apr. 6, 2020

(65) Prior Publication Data

US 2020/0316769 A1 Oct. 8, 2020

(30) Foreign Application Priority Data

Apr. 8, 2019 (IT) ..... 102019000005382

(51) Int. Cl.
*B25H 1/16* (2006.01)
*B25H 1/04* (2006.01)
*B25H 1/12* (2006.01)

(52) U.S. Cl.
CPC ..... *B25H 1/16* (2013.01); *B25H 1/04* (2013.01); *B25H 1/12* (2013.01)

(58) Field of Classification Search
CPC ..... A47B 1/10; A47B 13/081; A47B 17/065; A47B 21/00; A47B 21/02; A47B 21/03; A47B 22/00; A47B 22/0038; A47B 22/0068; A47B 22/008; A47B 83/04; A47B 83/045; B25H 1/04; B25H 1/12; B25H 1/16; B25H 1/18
See application file for complete search history.

(56) References Cited

U.S. PATENT DOCUMENTS 4,709,971 A * 12/1987 Leeds ..... A47B 21/00 312/201
5,743,603 A * 4/1998 Kelley ..... A47B 21/00 312/195
5,839,780 A 11/1998 Cauffiel
6,493,217 B1 * 12/2002 Jenkins, Jr. ..... A47B 21/00 108/147
2005/0022699 A1 2/2005 Goza

FOREIGN PATENT DOCUMENTS

GB 2388532 A 11/2003
KR 20050104141 A 11/2005

* cited by examiner

*Primary Examiner* — Tyrone V Hall, Jr.
(74) *Attorney, Agent, or Firm* — ArentFox Schiff LLP; Michael Fainberg

(57) ABSTRACT

A movable workstation comprising at least one work plane; a base assembly, said work plane being supported by said base assembly, said base assembly comprising wheels for resting said movable work station on a floor and for moving said workstation along said floor; wherein said base assembly comprises: a support structure comprising a bearing structure adapted to be rested on the floor and a upright structure connected to, and interposed between, said rest structure and said at least one work plane; at least one container supported to said base assembly; and wherein at least one of the at least one work plane is constrained to said upright structure in a translatable manner with respect to said base assembly according to one plane parallel to said at least one of the at least one work plane.

13 Claims, 7 Drawing Sheets

SMALL-SIZE, MOVABLE WORKSTATION

CROSS-REFERENCE TO RELATED APPLICATION

This application claims priority to Italian Patent Application No. 10201900005382 filed Apr. 8, 2019, the entire contents of which is hereby incorporated in its entirety by reference.

FIELD OF TECHNOLOGY

The invention relates to a small, movable workstation. The workstation can be easily moved from one room to another in order to position it in a temporarily available location and can be easily transformed and adapted to the contingent working needs of the user or worker.

BACKGROUND OF THE INVENTION

The jobs of many professionals do not allow them to remain static in the same location because they are always on the move, both on-site and off-site.

This is often the case of independent contractors or managers who frequent the company exclusively to meet co-workers or clients, alternating their present in meeting rooms and private offices in which they are hosted as needed.

However, when these professionals arrive at the office they need a "touchdown spot", i.e. a very small place where to put their bag, laptop, send a few quick e-mails, make a phone call or have a physical reference place inside the company, a place on which they can rely during the working day.

Therefore, the need is felt to provide a workstation which can be easily moved and transformed, which is small in size in the closed position, and which allows temporary users to fulfill all their office-work-related needs.

SUMMARY OF THE INVENTION

It is the object of the present invention to devise and make available a movable workstation which allows satisfying the aforesaid needs and to at least partially overcome the drawbacks described above with reference to the prior art.

In particular, it is an object of the present invention to provide a workstation which can be easily moved and transformed, which is small in size in the closed position, and which allows temporary users to fulfill all their office-work-related needs.

It is another object of the present invention to provide a movable workstation which allows the users to adapt the position of the work plane to their requirements in terms of posture and ease of use, and to avoid the problem of obstructing the user's legs when the user sits frontally or sideways on it.

It is another object of the present invention to provide a movable workstation which provides sufficient support surfaces for documents and electronic devices.

It is a further object of the present invention to provide a movable workstation which allows the power or charging of electronic work devices.

It is yet another purpose of the present invention to provide a movable workstation which allows the users to safely store their documents and devices.

These and further objects and benefits are achieved by means of a movable workstation according to independent claim 1, as well as a method of adjusting a movable workstation according to independent claim 11.

Further objects, solutions, and advantages are present in the embodiments described below and claimed in the dependent claims.

BRIEF DESCRIPTION OF THE DRAWINGS

The invention will be illustrated below by describing some embodiments by way of non-limiting example, with reference to the accompanying figures, in which.

DETAILED DESCRIPTION

Figure 1:
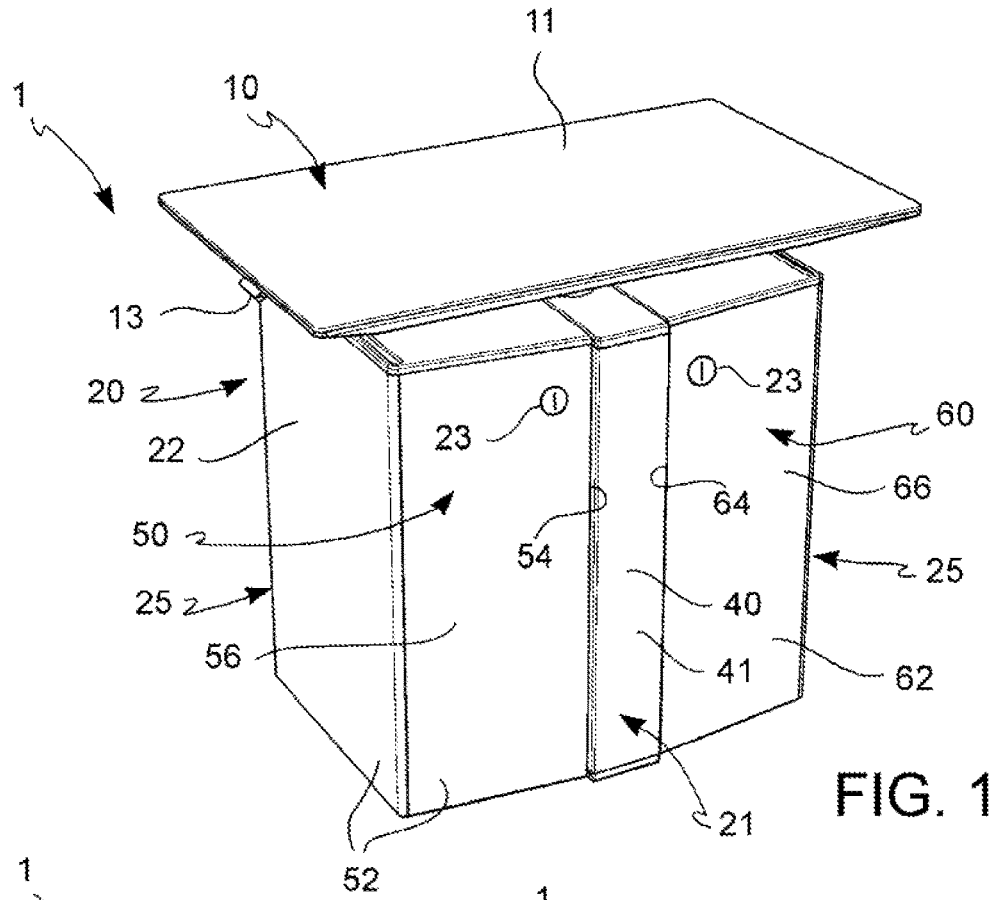
FIG. 1 shows a perspective view of a movable workstation according to the invention in close position.
Figure 2:
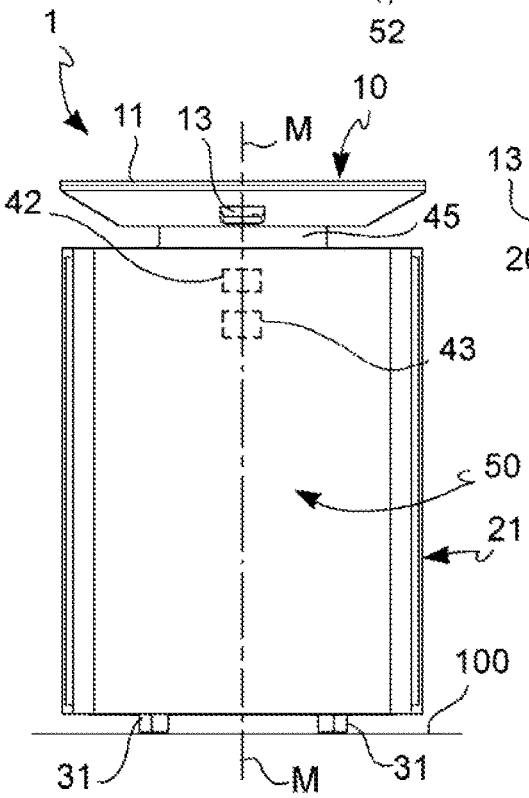
FIGS. 2 and 3 show a side view and a front view of the workstation in FIG. 1, respectively.
Figure 3:
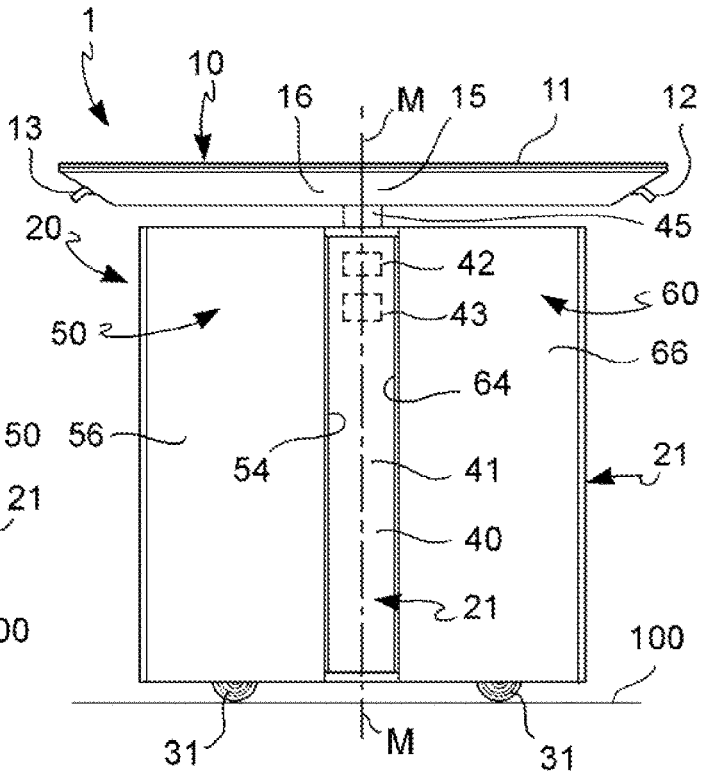
Figure 4:
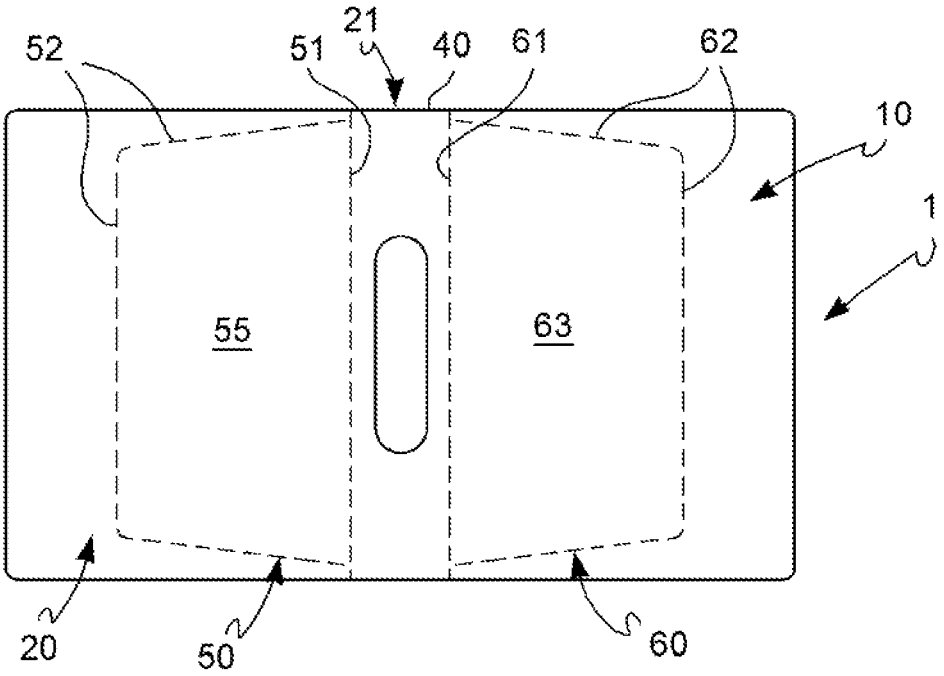
FIG. 4 shows a plan view of the workstation in FIG. 1, in which the contours of the base assembly, which are not visible through the work plane, are indicated with a dotted line.
Figure 5:
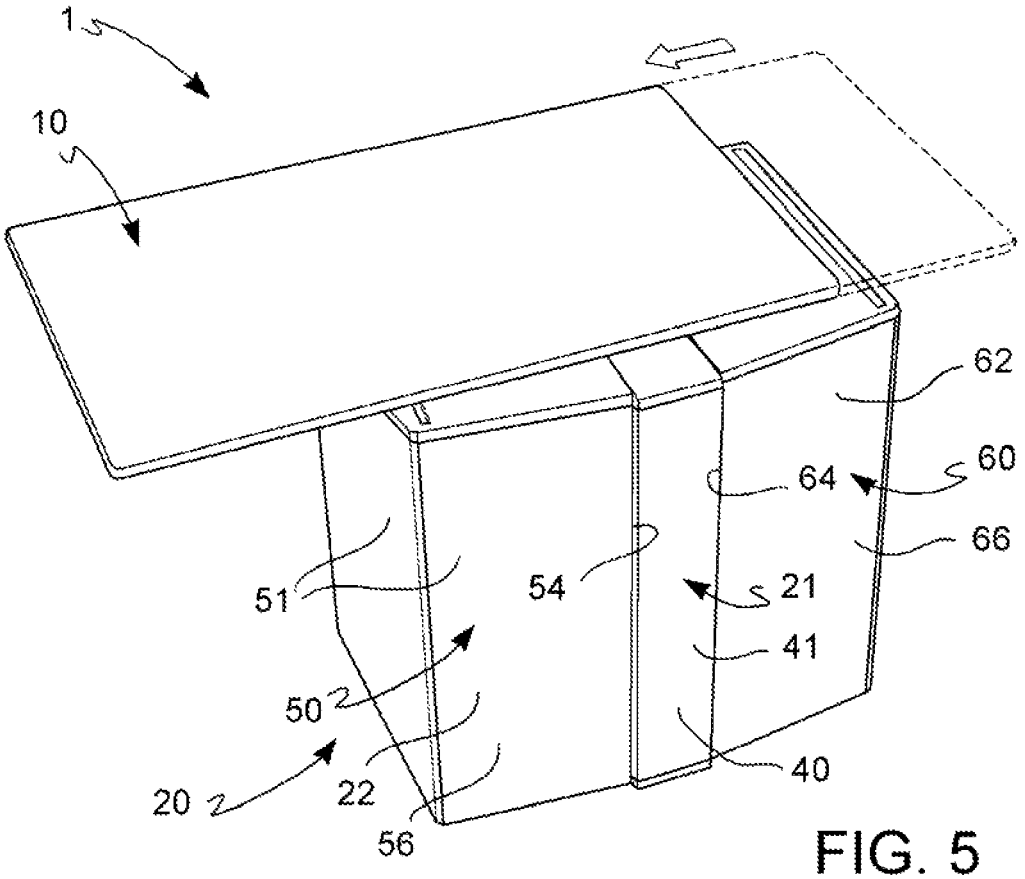
FIG. 5 shows a perspective view of the workstation in FIG. 1, wherein the work plane is translated laterally to a position overhanging the base assembly, in which the dashed lines indicate the position of the work plane before being translated.
Figure 6:
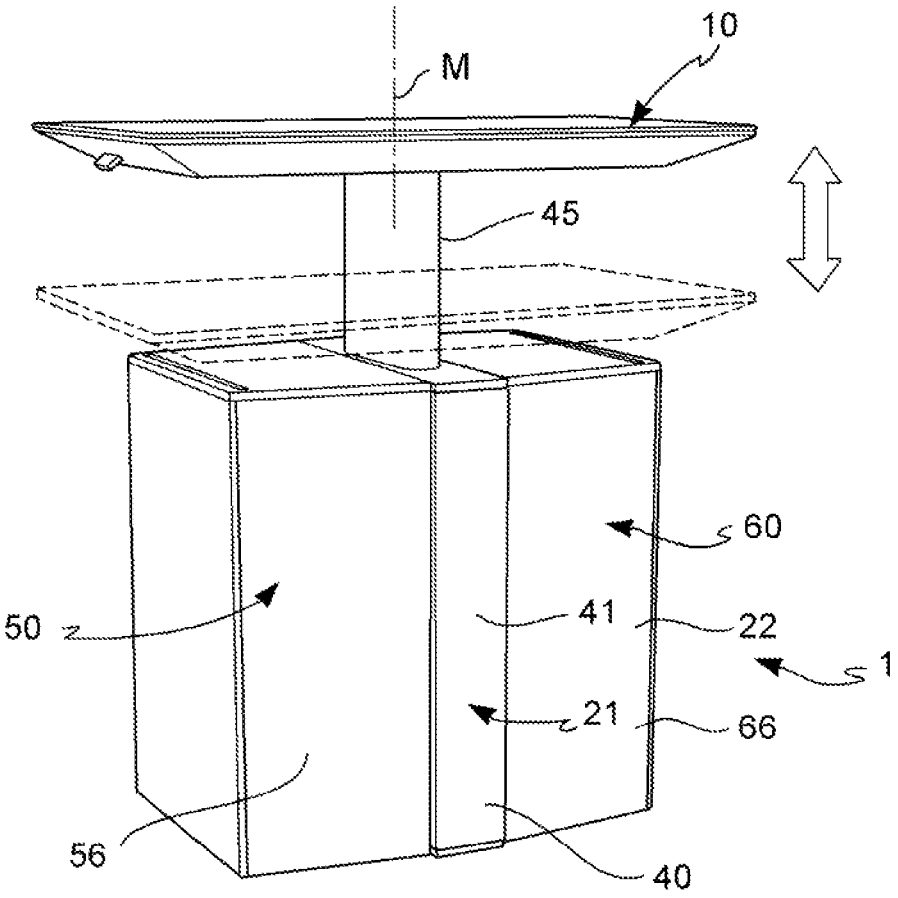
FIG. 6 shows a perspective view of the workstation in FIG. 1, wherein the work plane is in a raised position with respect to the one shown in FIG. 1, wherein the dashed lines show the position of the work plane before it is raised.
Figure 7:
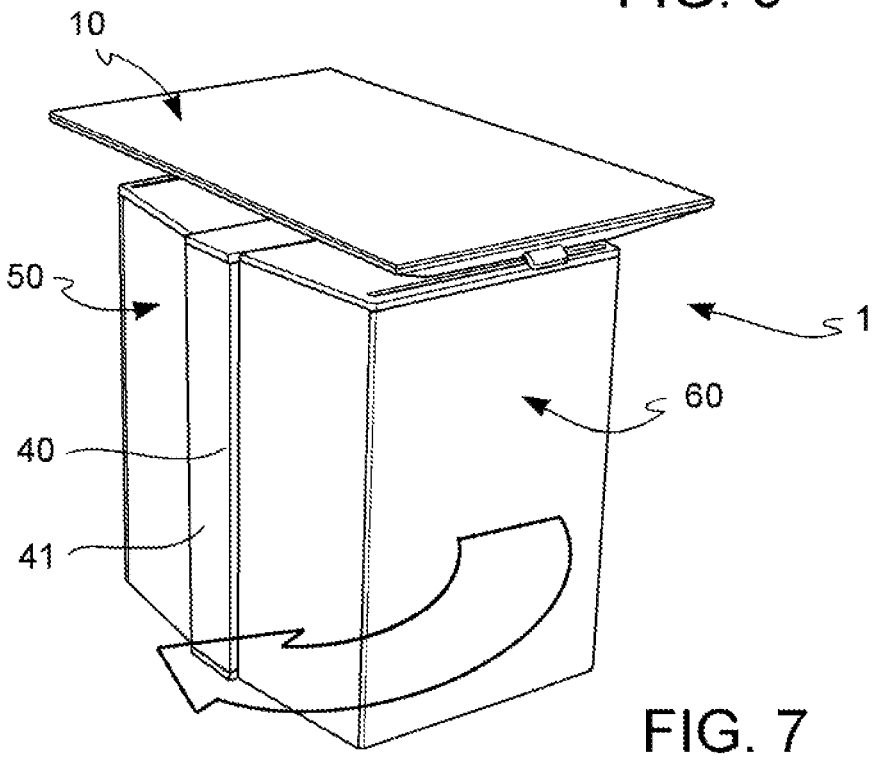
FIG. 7 shows a perspective view of the workstation of FIG. 1 from a different angle, in which the curved arrow indicates a direction of opening by rotation of a semi-shell of the container.
Figure 8:
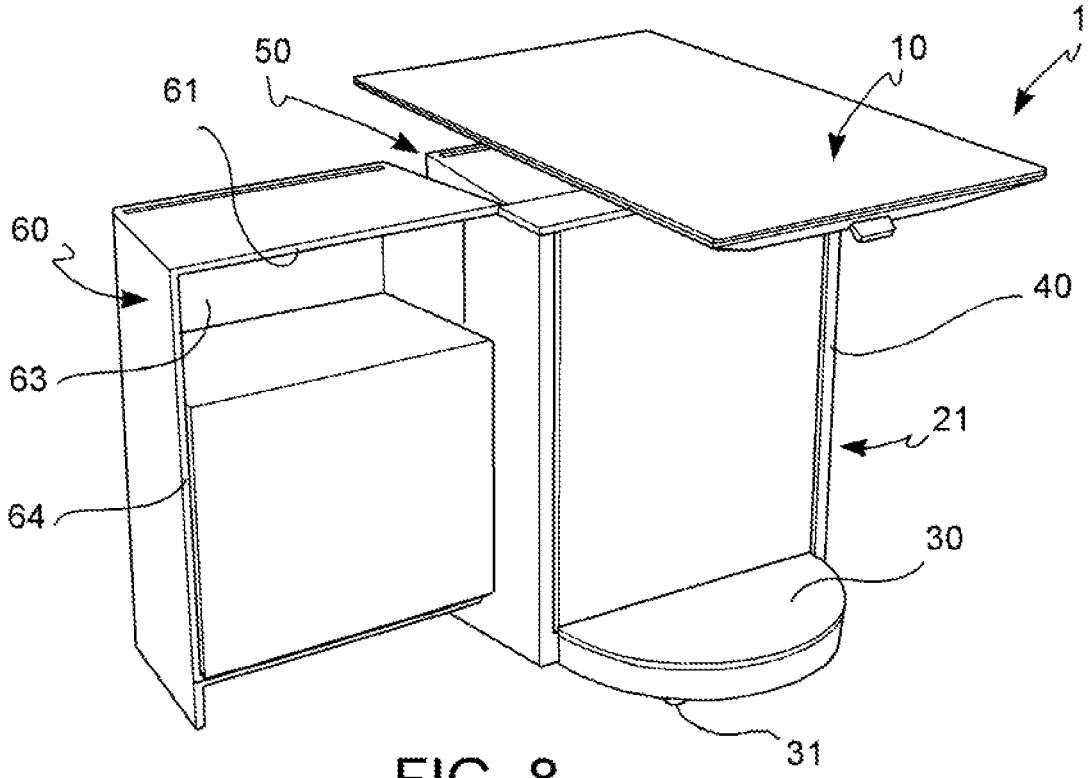
FIG. 8 shows a perspective view of the workstation according to the invention, wherein a semi-shell is in the open and rotated position, wherein such a semi-shell contains a compartment with a hinged door in the closed position.
Figure 9:
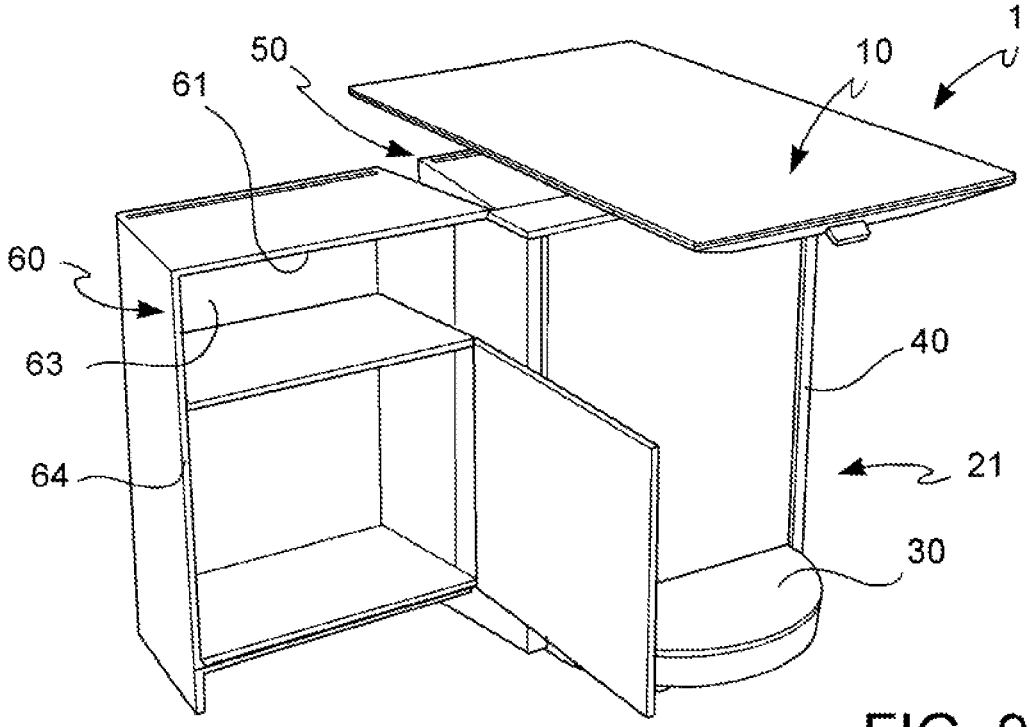
FIG. 9 shows a perspective view of the workstation in FIG. 9, in which the door is open.
Figure 10:
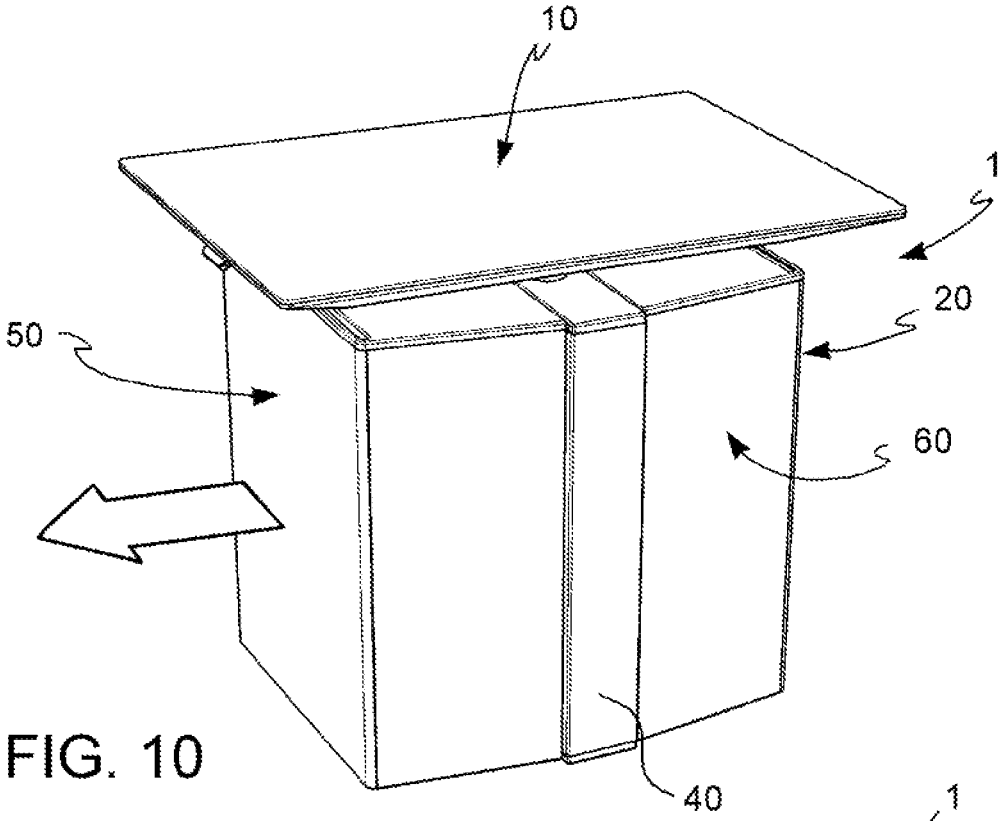
FIG. 10 shows a perspective view of the workstation of FIG. 1 in a closed position, in which a straight arrow shows an opening direction for the straight linear translation only of a semi-shell of the container.
Figure 11:
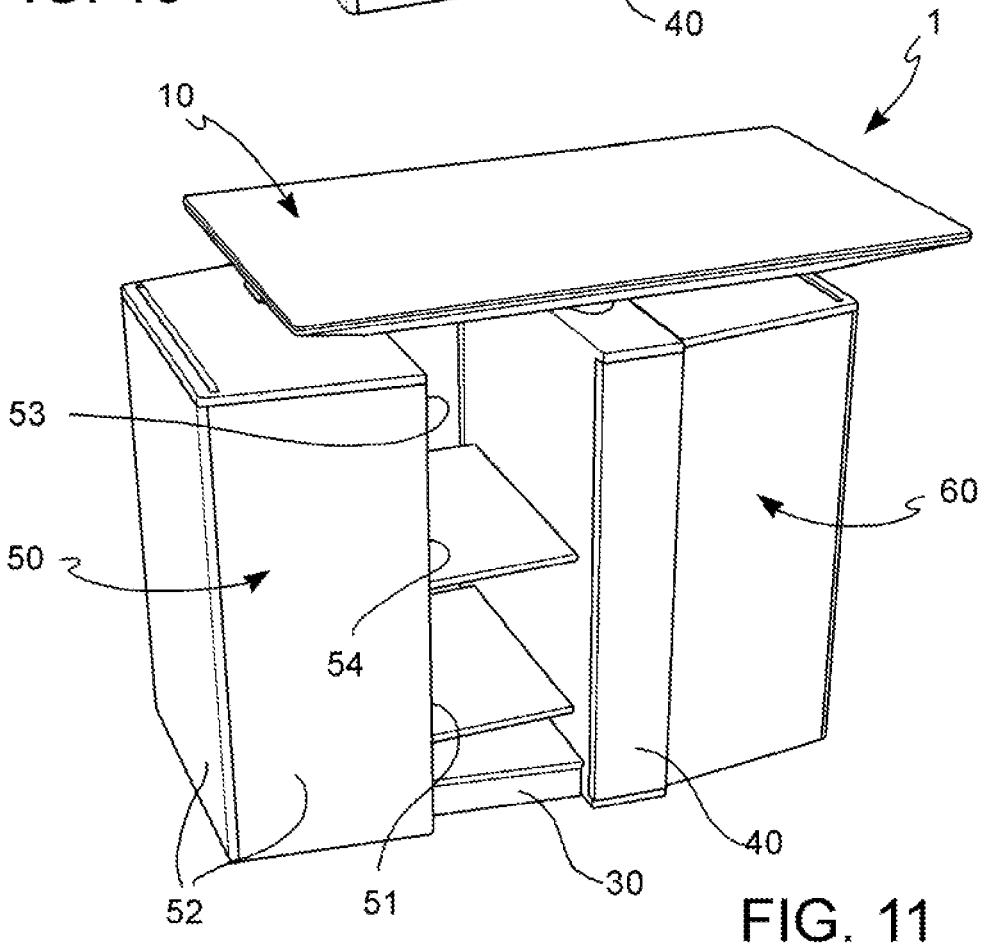
FIG. 11 shows the workstation in FIG. 10, where the semi-shell is in the open position by translation.
Figure 12:
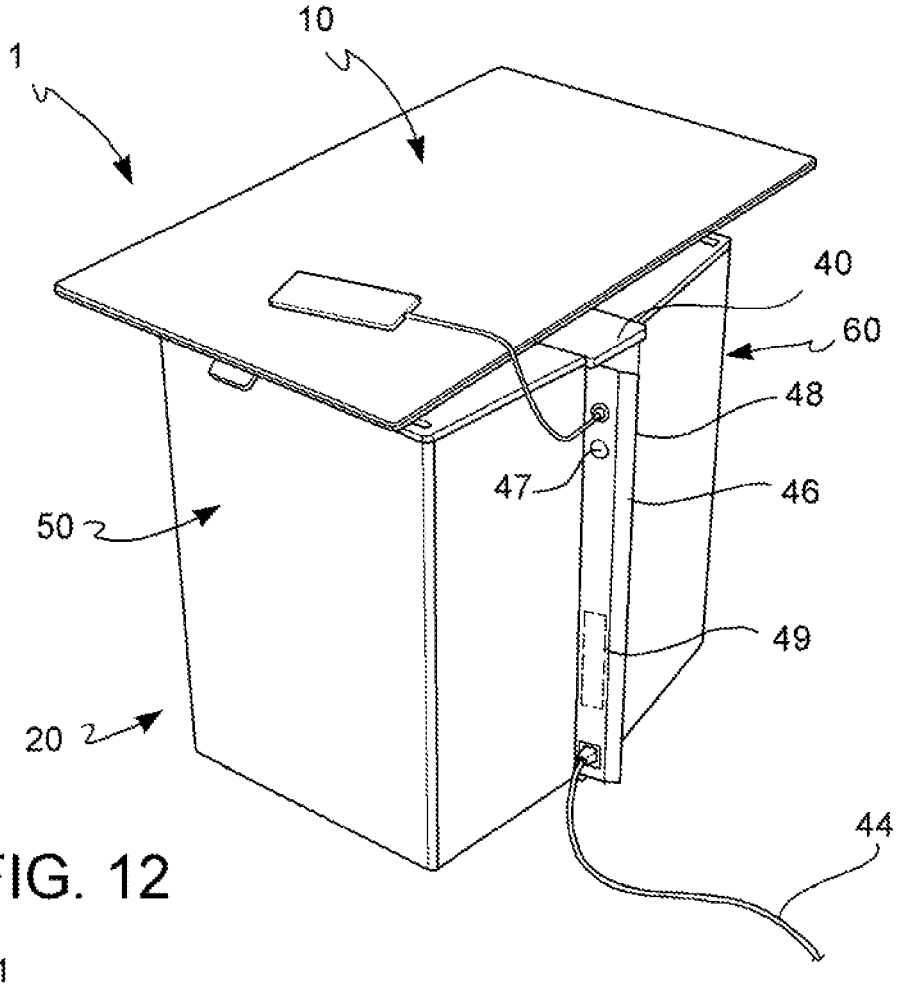
FIG. 12 shows a perspective view from another angle of the workstation in FIG. 1 in closed position, in which the basic assembly, in particular the upright structure, comprises an extractable panel comprising power supply and/or data connection connectors; in which such a panel is shown in the extracted position.
Figure 13:
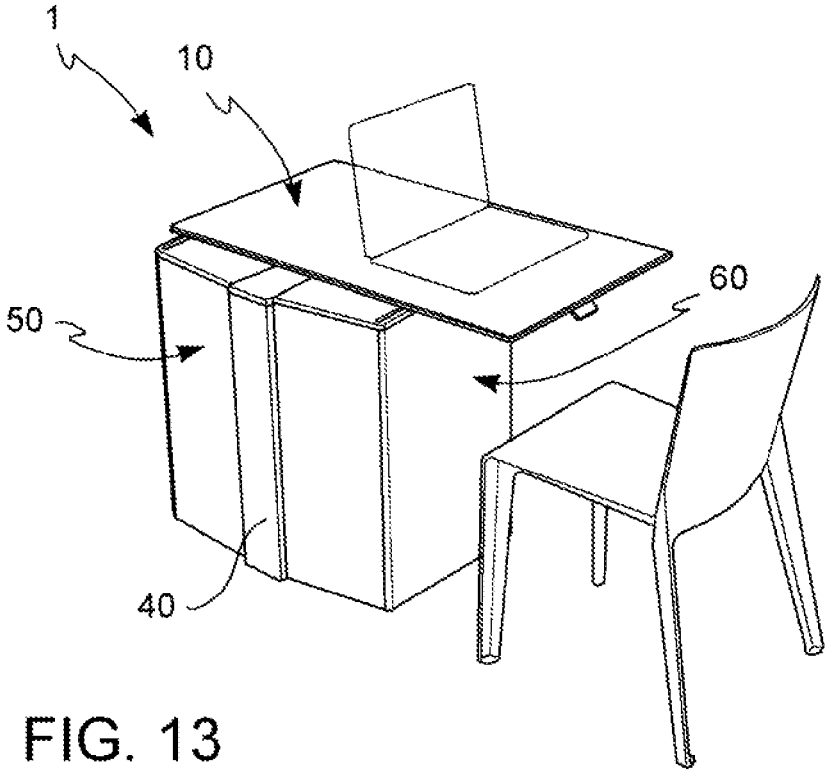
FIG. 13 shows a perspective view of a workstation according to the invention, in which the work plane is in a cantilevered position with respect to the base assembly, and in which a chair is shown near the cantilevered portion of the work plane.
Figure 14:
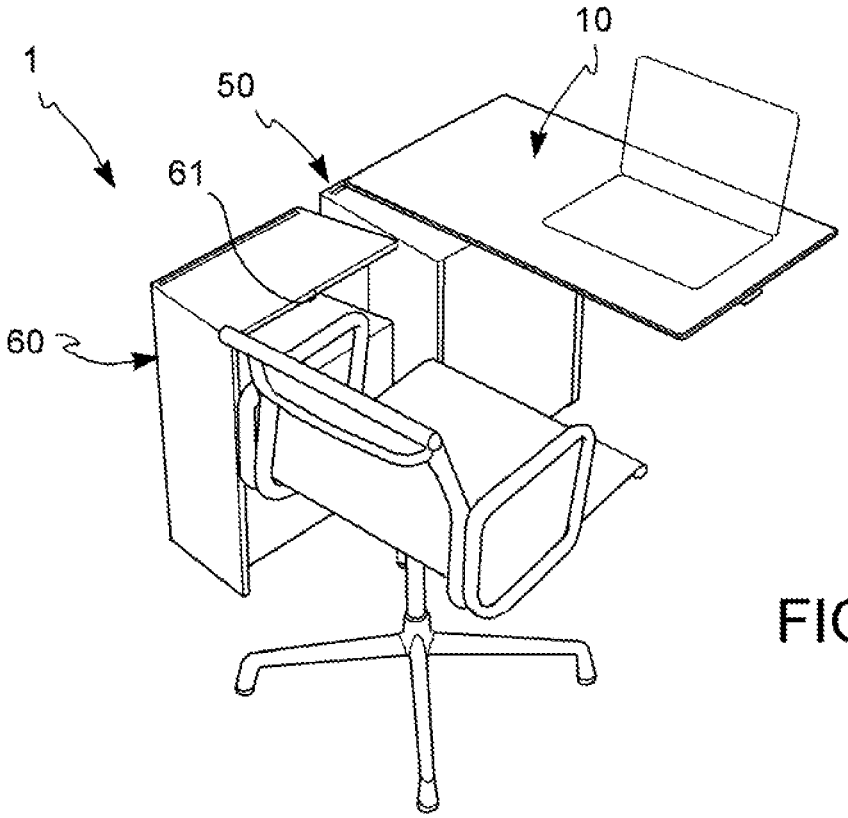
FIG. 14 shows a perspective view of a workstation according to the invention, in which a semi-shell is rotated in open position, in which the work plane is in a cantilevered position, and in which a chair is shown in a working position near the work plane.
Figure 15:
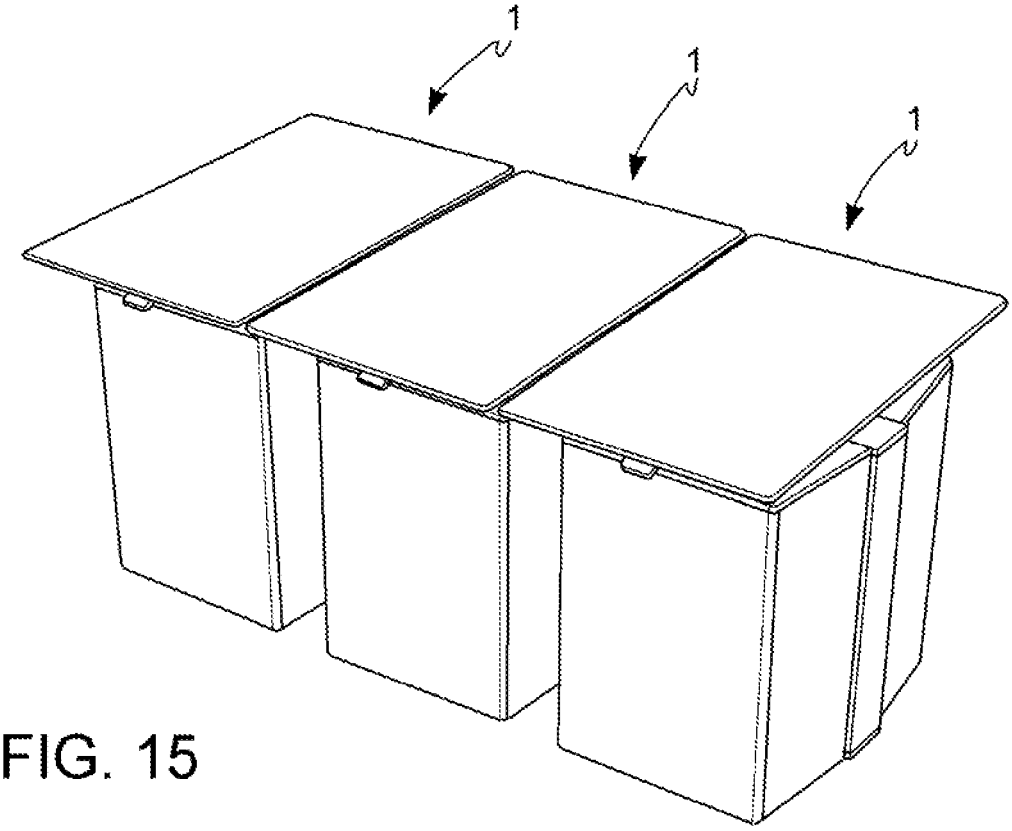
FIG. 15 shows a perspective view of a plurality of workstations according to the invention in a closed position, in which the workstations are placed side-by-side and gathered together in a rechargeable electric battery charging station arranged in such workstations.

With reference to the figures, an adjustable guide assembly according to the invention is indicated by reference numeral 1 as a whole.

A movable workstation is a unit of functional office furniture, which provides shelves for office work and which can be easily moved, even by the users themselves.

The movable workstation 1 comprises at least one work plane 10 and a base assembly 20.

The work plane 10 is supported by the base assembly 20.

The base assembly 20 comprises wheels 31 for resting the movable workstation 1 on a floor 100 and for moving said workstation 1 along the floor 100.

The work plane 10 defines a work surface 11 at the top or on the opposite side of the base assembly.

Hereinafter, when a specific direction with respect to the work plane 10 is indicated, it will be understood to refer to a specific direction with respect to work plane 11.

According to a preferred embodiment, the work surface 11 is either flat or substantially flat.

The base assembly 20 comprises a support structure 21, which comprises a bearing structure 30 adapted to be rested on the floor 100 and a upright structure 40 connected to, and interposed between, said bearing structure 30 and said at least one work plane 10.

Preferably, the upright structure 40 is arranged transversally to the work plane 10, preferably substantially orthogonal to the work plane 10.

The base assembly 20 comprises at least one container 25 supported by said base assembly 20.

Preferably, said at least one container 25 is constrained to said support structure 21.

According to an embodiment, said at least one of the at least one work plane 10 comprises a connection portion 15 and a free portion 16, wherein said connection portion is connected to said upright structure 40 and said free portion 16 is translatable with respect to said base assembly 20 up to a cantilevered protruding position with respect to said base assembly 20.

According to an embodiment, said upright structure 40 comprises a locking device 42 for locking or freeing the translation movement of said at least one of the at least one work plane 10 with respect to said base assembly 20.

According to an embodiment, said locking device 42 comprises a control device 12 operable by a user.

According to an embodiment, said control device 12 is placed below said at least one work plane 10 close to an edge thereof.

According to an embodiment, at least one of the at least one work plane 10 is adjustable in height with respect to the base assembly 20, in order to modify the position and distance of said work plane 10 from said floor 100.

For example, the upright structure 40 forms one or more columns arranged transversely, e.g. substantially orthogonal, to said at least one work plane 10.

Preferably, the upright structure 40 is formed by a column 45.

According to an embodiment, said upright structure 40 is a single telescopic column 45.

According to an embodiment, said upright structure 40 is a telescopic column 45 arranged transverse to said at least one work plane 10.

According to an embodiment, said upright structure 40 comprises a second locking device 43 for locking or freeing the movement in height of said at least one of the at least one work plane 10 with respect to said base assembly 20.

According to an embodiment, said second locking device 43 comprises a second control device 13 operable by a user.

According to an embodiment, said second control device 13 is placed below said at least one of the at least one work plane 10 close to an edge thereof.

Each of said one or more columns, or said single column 45, can be telescopically extended in a transverse direction, preferably substantially orthogonal, to at least one work plane 10.

According to an embodiment, the at least one container 25 has an openable box-like structure formed by semi-shells 50, 60.

According to an embodiment, each of said semi-shells 50, 60 defines a semi-shell open side 51, 61 and semi-shell walls 52, 62 arranged about said semi-shell open side 51, 61 so as to form a semi-shell inner compartment 53, 63.

According to an embodiment, the open side of the semi-shell 51, 61 defines a semi-shell edge 54, 64.

According to an embodiment, at least one of said semi-shells 50, 60, preferably each of them, is constrained to the support structure 21, preferably to the upright structure 40, in a movable manner between a closed position and an open position.

In the closed position, either said semi-shell 50, 60 or said semi-shells 50, 60 are arranged close to said upright structure 40, with said semi-shell open side 51, 61 facing and in contact with said upright structure 40, to close said semi-shell inner compartment 54, 64, and to prevent access to the inside of at least one container 25.

Preferably, in said closed position, at least one semi-shell 50, 60 is placed with said semi-shell edge 54, 64 completely in contact with said upright structure 40.

In said open position, at least one semi-shell 50, is at least partly moved away from said upright structure 40, allowing access to the semi-shell inner compartment 53, 63, between said semi-shell 50, 60 and said upright structure 40.

In said open position, at least one semi-shell 50, 60 is arranged with said semi-shell edge 54, 64 at least partially detached from said upright structure 40.

According to an embodiment, at least one of said semi-shells 50, 60 is rotatably constrained to said upright structure 40.

According to an embodiment, at least one of said semi-shells 50, 60 is rotatably constrained to said upright structure 40 about an axis transverse to said work plane 10.

According to an embodiment, at least one of said semi-shells 50, 60 is translatably constrained to said upright structure 40.

According to an embodiment, at least one of said semi-shells 50, 60 is translatably constrained to said upright structure (40) along a direction parallel to the work plane (10).

According to a preferred embodiment, the at least one container is formed by two semi-shells facing each other 50, 60, on opposite sides of the upright structure 40.

According to an embodiment, one of said two semi-shells is constrained to said upright structure 40 in a translatable manner along a direction parallel to the work plane 10, and the other of said two semi-shells is constrained to said upright structure 40 in a rotatable manner around a transverse axis to said work plane 10.

According to an embodiment, the base assembly 20, in a closed position, defines a base assembly lateral outer surface 22 as a whole, and wherein the semi-shell walls 52, 62 define respective shell outer surfaces 56, 66, wherein the shell outer surface 56, 66 of each semi-shell 50, 60 forms, at least partially, said base assembly lateral outer surface 22.

According to an embodiment, the upright structure 40 has a upright structure lateral outer surface 41, wherein said upright structure outer lateral surface 41 forms part of said base assembly lateral outer surface 22.

According to an embodiment, the box-like structure of said at least one container 25 can be safely closed.

According to an embodiment, said openable box-like structure of said container 25 can be closed in safety with a lock device 23.

In other words, the openable box-like structure of at least one container 25 comprises a locking device 23, preferably a key lock, to prevent undesired opening of at least one container 25.

According to an embodiment, the base assembly 20 comprises an extractable panel 46 comprising connectors 47 of a power supply and/or data connection.

According to an embodiment, said power supply and/or data transmission connectors 47 converge into a wiring connectable to a mains power supply and a data transmission device, such as, for example, a Wi-Fi connection device and/or a router.

According to an embodiment, the extractable panel 46 is movable between an extracted position, in which the power supply and/or data connection connectors 47 are exposed to the outside, and a retracted position, in which the power supply and/or data connection connectors 47 are hidden from view.

According to an embodiment, the extractable panel 46 defines a portion of panel outer side surface 48 free from said power supply and/or data connection connectors 47, which, in said retracted position, forms said upright structure outer side surface 41.

According to an embodiment, the movable work station 1 comprises at least one electric battery 49 adapted to supply electricity independently of a connection to a mains outlet.

Preferably, the at least one electric battery 49 is arranged inside said base assembly 20, preferably inside said upright structure 40, or inside said extractable panel 46.

According to an embodiment, said at least one electric battery is connected to said power supply connectors 47.

According to an embodiment, the movable workstation 1, preferably the base assembly 20, even more preferably the upright structure 40, comprises an electronic charging device for recharging said at least one electric battery 47.

According to an embodiment, the movable workstation comprises an electrical cable 44 to electrically connect said power supply connectors 47 to an electrical power network, and/or to connect said electronic charging device to an electricity supply network.

According to another aspect of the present invention, the aforesaid and other purposes and advantages are achieved by a method for adjusting a movable workstation 1 according to the features described above.

Said method comprises a step of providing a movable workstation 1 as described above; moving said movable work station 1 into a comfortable working position; translating the at least one of the at least one work plane 10 with respect to the base assembly 20 according to a plane parallel to said at least one of the at least one work plane 10 in order to be able to use the work station 1 from sitting bringing the legs below the work plane 10 without encountering any obstacle.

According to an embodiment, the method comprises a step of adjusting the height of at least one of the at least one work plane 10 with respect to the base assembly 20, in order to modify the position and distance of said work plane 10 from said floor 100.

According to an embodiment, the method comprises a step of adjusting the height of the at least one work plane 10 with respect to the base assembly 20, in order to modify the position and distance of said work plane 10 from said floor 100 in order to bring said work plane 10 to a useful working height using the work plane 10 while sitting and to a useful working height, using the work plane 10 while standing.

According to an embodiment, the method comprises a step of opening at least one of said semi-shells 50, 60 by means of translation with respect to the upright structure 40.

According to an embodiment, the method comprises a step of opening at least one of said semi-shells 50, 60 by means of rotation with respect to said upright structure 40 about an axis transverse to said work plane 10.

According to an embodiment, the method comprises a step of opening at least one of said semi-shells 50, 60 by means of translation with respect to said upright structure 40.

According to an embodiment, the method comprises a step of opening at least one of said semi-shells 50, 60 by means of translation with respect to said upright structure 40 along a direction parallel to the work plane 10.

According to an embodiment, the method comprises a step of connecting said movable work station 1 to a power supply and/or a data transmission network.

According to an embodiment, the method comprises a step of connecting said movable workstation 1 to a power supply for recharging at least one electric battery 71 arranged in said movable workstation 1.

A person skilled in the art may make changes and adaptations to the embodiments of the device described above or can replace elements with others which are functionally equivalent to satisfy contingent needs without departing from the scope of protection of the appended claims. All the features described above as belonging to one possible embodiment may be implemented independently from the other described embodiments.

The means and materials for making the various described functions may be of various nature without departing from the scope of the invention.

Furthermore, it is worth noting that the figures are not necessarily in scale.

All the features described here may be combined in any combination, except for the combinations in which at least some of such features mutually exclude one another.

The invention claimed is:

1. A movable workstation comprising at least one work plane;

a base assembly;

said work plane being supported by said base assembly, said base assembly comprising wheels for resting said movable work station on a floor and for moving said work station along said floor;

wherein said base assembly comprises:

a support structure comprising a bearing structure adapted to be rested on the floor and an upright structure connected to, and interposed between, said bearing structure and said at least one work plane;

at least one container supported to said base assembly;

wherein at least one of the at least one work plane is constrained to said upright structure in a translatable manner with respect to said base assembly according to one plane parallel to said at least one of the at least one work plane;

wherein the at least one container has an openable box-like structure formed by two semi-shells facing each other on opposite sides of the upright structure, each of said two semi-shells defining a semi-shell open side and semi-shell walls arranged about said semi-shell open side so as to form a semi-shell inner compartment;

wherein at least one of said semi-shells is rotatably constrained to said upright structure about an axis transverse to said work plane (10) between a closed position and an open position;

wherein, in said closed position, the base assembly, defines a base assembly lateral outer surface as a whole, and wherein the semi-shell walls define respective shell outer surfaces, wherein the shell outer surface of each semi-shell forms, at least partially, said base assembly lateral outer surface;

and wherein, in said open position, said at least one semi-shell is at least partly moved away from said upright structure, allowing access to the semi-shell inner compartment, between said semi-shell and said upright structure.

2. A movable work station, according to claim 1, wherein said at least one of the at least one work plane comprises a connection portion and a free portion, wherein said connection portion is connected to said upright structure and said free portion is translatable with respect to said base assembly until a cantilevered protruding position with respect to said base assembly;

and/or wherein said upright structure comprises a locking device for locking or freeing the translation movement of said at least one of the at least one work plane with respect to said base assembly;

and/or wherein said locking device comprises a control device operable by a user and/or wherein said control device is placed below said at least one work plane close to an edge thereof and/or wherein said at least one container is constrained to said support structure.

3. A movable work station, according to claim 1, wherein said at least one of the at least one work plane is adjustable in height with respect to the base assembly, in order to modify the position and distance of said work plane from said floor.

4. A movable work station, according to claim 1, wherein the upright structure is formed by a column;

and/or wherein said upright structure is a single telescopic column and/or wherein said upright structure is a telescopic column arranged transverse to said at least one work plane;

and/or wherein said upright structure comprises a second locking device for locking or freeing the movement in height of said at least one of the at least one work plane with respect to said base assembly;

and/or wherein said second locking device comprises a second control device operable by a user;

and/or wherein said second control device is placed below said at least one of the at least one work plane close to an edge thereof.

5. A movable work station, according to claim 1, wherein at least one of said semi-shells is translatably constrained to said upright structure;

and/or wherein at least one of said semi-shells is translatably constrained to said upright structure along a direction parallel to the work plane.

6. A movable work station, according to claim 1, wherein the openable box-like structure of said container can be closed in safety;

and/or wherein said openable box-like structure of said container can be closed in safety with a lock device.

7. A movable work station, according to claim 1, wherein the base assembly comprises an extractable panel comprising connectors of a power supply and/or data connection;

and/or wherein said power supply and/or data transmission connectors converge into a wiring connectable to a mains power supply and a data transmission device, such as, for example, a Wi-Fi connection device and/or a router.

8. A movable work station, according to claim 1, comprising at least one electric battery adapted to supply electricity users independently of a connection to a mains socket.

9. A method for adjusting a movable work station, comprising the steps of:

providing a movable work station as defined in claim 1;

moving said movable work station into a comfortable working position;

translating the at least one of the at least one work plane with respect to the base assembly according to a plane parallel to said at least one of the at least one work plane in order to be able to use the work station from sitting bringing legs below the work plane without encountering any obstacle;

opening at least one of said semi-shells by means of rotation with respect to said upright structure about an axis transverse to said work plane.

10. An adjustment method, according to claim 9, comprising a step of adjusting the height of at least one of the at least one work plane with respect to the base assembly, in order to modify the position and distance of said work plane from said floor;

and/or wherein said method comprises a step of adjusting the height of the at least one of the at least one work plane with respect to the base assembly, in order to modify the position and distance of said work plane from said floor in order to bring said work plane to a useful working height using the work plane sitting and to a useful working height, using the work plane standing.

11. An adjustment method, according to claim 9, comprising a step of opening at least one of said semi-shells by means of translation with respect to said upright structure;

and/or wherein said method comprises a step of opening at least one of said semi-shells by means of rotation with respect to said upright structure about an axis transverse to said work plane.

12. An adjustment method, according to claim 9, comprising a step of connecting said movable work station to a power supply and/or a data transmission network.

13. An adjustment method, according to claim 9, comprising a step of connecting said movable work station to a power supply for recharging at least one electric battery arranged in said movable work station.

* * * * *